United States Patent [19]

Rein

[11] Patent Number: 4,742,936

[45] Date of Patent: May 10, 1988

[54] DISPENSING DEVICE WITH NUMERICAL INDICATOR FOR INVENTORY CONTROL

[75] Inventor: Gary Rein, Montclair, N.J.

[73] Assignee: The Display Equation, Inc., New York, N.Y.

[21] Appl. No.: 71,605

[22] Filed: Jul. 9, 1987

Related U.S. Application Data

[63] Continuation of Ser. No. 819,142, Jan. 15, 1986, abandoned.

[51] Int. Cl.[4] ..... A47F 7/28; A47F 1/12

[52] U.S. Cl. ..... 221/5; 211/59.3; 221/270; 221/279; 312/71

[58] Field of Search ..... 221/4, 5, 8, 244, 271, 221/279, 270; 312/71; 211/59.3

[56] References Cited

U.S. PATENT DOCUMENTS

| | | | |
|---|---|---|---|
| 3,110,402 | 11/1963 | Mogulescu | 211/59.3 |
| 3,166,195 | 1/1965 | Taber | 211/59.3 X |
| 3,436,136 | 4/1969 | McKechnie | 312/71 |
| 3,591,049 | 7/1971 | Auriemma | 221/279 |
| 3,724,715 | 4/1973 | Auriemma | 221/4 |
| 3,780,873 | 12/1973 | Silva | 211/59.3 |
| 4,106,668 | 8/1978 | Gebhardt et al. | 221/279 X |
| 4,303,162 | 12/1981 | Suttles | 211/59.3 |
| 4,386,710 | 6/1983 | Dauman | 312/71 X |

FOREIGN PATENT DOCUMENTS

| | | | |
|---|---|---|---|
| 645212 | 10/1950 | United Kingdom | 211/59.3 |

*Primary Examiner*—Frank E. Werner
*Assistant Examiner*—P. McCoy Smith
*Attorney, Agent, or Firm*—Lieberman, Rudolph & Nowak

[57] ABSTRACT

A merchandise dispenser for storing and dispensing a plurality of items aligned within the dispenser and eased toward the front of the dispenser by a retractable member which is biased to push the remaining line of items forward when the first item in the line is removed. The dispenser is provided with an indicator which automatically indicates the quantity of items remaining in the dispenser.

1 Claim, 2 Drawing Sheets

DISPENSING DEVICE WITH NUMERICAL INDICATOR FOR INVENTORY CONTROL

CROSS-REFERENCE

This is a continuation of Ser. No. 819,142, filed Jan. 15, 1986, now abandoned.

BACKGROUND OF THE INVENTION

In modern retail merchandising and warehousing situations, items are stored on shelves, each item stored adjacent to other identical items forming rows perpendicular to the shelves. The result is that on a fully stocked merchandise shelf, there exists a row of item A next to a row of item B and so on, so that to the observer or customer, only the first of each type of item is visible. Where such an arrangement is used to display merchandise for sale, a properly inventoried and maintained arrangement translates into increased profits through a maximum use of space.

Problems arise however when such arrangements for storing, displaying and dispensing of merchandise are not controlled and such merchandise is removed from the back or middle of the various rows leaving the front position of the row filled and those positions in back of it empty. This results in the visual appearance of fully stocked shelves, when in fact one or many of the rows are in need of restocking. The misleading visual indication of items remaining in individual rows results in a decrease in profits and an increased amount of disorder among the remaining items on the shelf. In a situation where appearance is important, the disorder acts to discourage the customer from buying the items displayed.

It is an object of the present invention herein described to eliminate these problems and maximize the use of shelf space by maintaining various items of merchandise in their respective rows.

It is a further object of this invention to constantly push the remaining items toward the front of their respective row thereby filling any gaps.

It is yet a further object of this invention to visually indicate for each row, the quantity of items remaining in that row so that effective inventory accounting and restocking can be maintained.

SUMMARY OF THE INVENTION

The invention consists of a dispenser for the storage, display and dispensing of items of identical size. It includes an indicator which automatically displays the quantity of items remaining in the dispenser. The items are placed on a shelf within the dispenser a movable platform is mounted on the shelf. In the preferred embodiment of the invention, a spring is mounted between the platform and the rear of the dispenser which applying pressure against the platform and the items stored adjacent to it, thereby urging the remaining items toward the front of the dispenser. The dispenser is interconnectable laterally with other such dispensers to form shelves which are in turn stackable. The dispensers can be of different sizes and capacities depending on the size of the items to be dispensed. All items stored in one dispenser should be of the same size and inventory control group.

The quantity of remaining items in each dispenser is automatically indicated in the preferred embodiment of the invention through the use of a shelf coiling sheet, the subject of U.S. Pat. No. 3,416,115 by R. E. Taber.

The Taber patent describes a method for making a self coiling sheet. The self-recoiling sheet is one which can be extended and recoiled almost indefinitely without fatigue. Generally, a self-recoiling roll or sheet will always tend to return to its coiled state.

In the preferred embodiment of the invention herein described, one end of such a self coiling sheet, embossed with a range of numbers, is attached to the feeding member of the dispenser, the rest of the sheet threaded toward the front of the dispenser, through a viewing window and coiled around a spindle at the front of the dispenser, one number on the sheet visible through the window and equal to the quantity of items left in the dispenser. The numbers on the sheet are arranged and placed on the sheet so that as each item is removed from the dispenser, the sheet coils and the number indicated in the window decreases by one. Conversely, each item added to the dispenser pushes the platform back, uncoiling the sheet so that the number appearing at the window increases by one.

DETAILED DESCRIPTION

Figure 3:
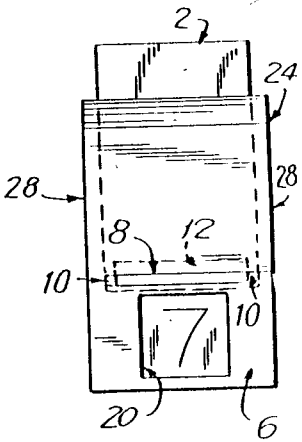
FIG. 3 is a front sectional view of the apparatus of FIG. 1 taken along line II—II.

Shown in the drawings is the preferred embodiment of the dispenser comprised of a rectangular trough with a movable platform 2 which presses against items of merchandise stored in the trough 4 urging the items toward the front end of the dispenser 6. The platform 2 is attached to a shelf 8, which is affixed to the sides of the dispenser and which is slotted 10 on both sides. The platform 2 travels freely along the inner portion of shelf 8 due to the rectangular slot 12 in the base of platform 2 which fits loosely around the inner portion of the shelf 8 and down through the slots 10 of the shelf 8. A bias mechanism, shown here as a coiled spring 14 is wound helically around the inner portion of the shelf 8 and down through the slots 10, thereby applying pressure against the platform 2 pushing it toward the front of the dispenser 6. One end of the self coiling sheet 16, embossed in this example with numbers is attached to the front end of the platform 2 at point A. The sheet 16 is threaded along the length of the dispenser, over the guide 18 and through viewing window 20 and is affixed to the spindle 22 where its self coiling action causes it to retract as the platform 2 is moved forward. A lip 24 is attached to the front side of the dispenser 6 to provide for ease of loading and unloading items.

Figure 1:
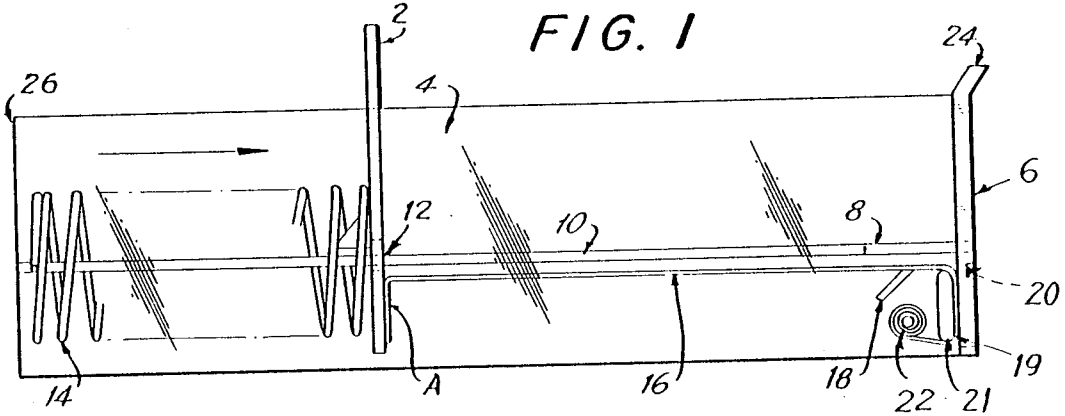
FIG. 1 is a lateral view of the preferred embodiment of the invention shown as being transparent so that the internal components can be viewed.
Figure 2:
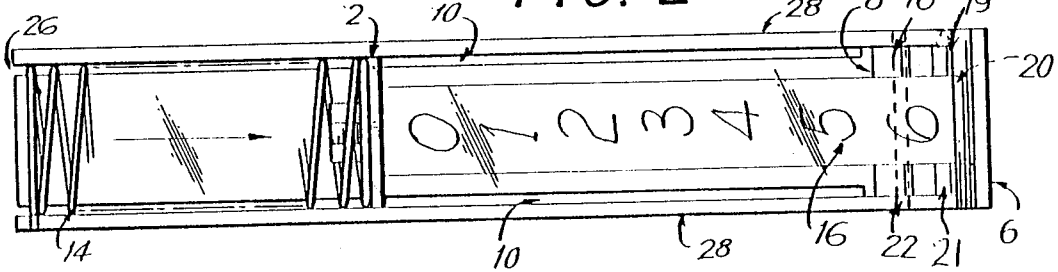
FIG. 2 is a top sectional view of the apparatus of FIG. 1.

FIG. 2 shows sectionally along line I—I, the numerically embossed sheet 16 through the shelf 8, herein shown transparently, together with other components shown and previously identified in FIG. 1.

FIG. 3 shows the number embossed on the sheet 16 visible through the window 20, as taken along line II—II of FIG. 1.

Figure 4:
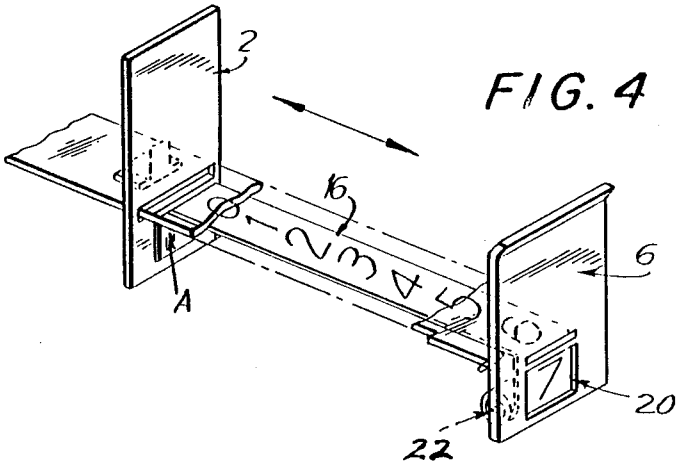
FIG. 4 is a perspective view of the indicating portion only of the preferred embodiment.

FIG. 4 shows the indicating means of the dispenser in a three dimensional perspective view.

Figure 5:
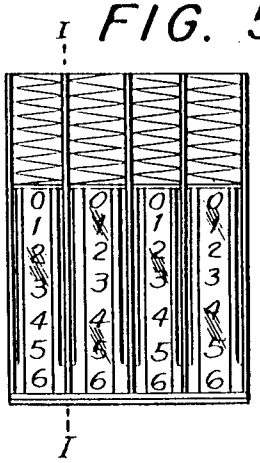
FIG. 5 is a top view showing a plurality of the dispensers comprising the invention joined along line I—I.

FIG. 5 shows four of the dispensers described in FIGS. 1 through 4, attached to each other along line I—I.

In general operation, items are inserted one at a time over the lip 24 and into the trough 4. As each item is inserted into the trough 4, the platform 2 is pressed against the spring 14 causing the spring 14 to compress. As the platform 2 is moved toward the rear of the dispenser 26, the sheet 16 is pulled at point A and uncoiled. As the sheet 16 uncoils, the embossed numerals on the sheet 16 appear one by one at the viewing window 20. The embossed numbers are arranged in numerical order with the lowest digit closest to the platform 2. The spacing between the numbers is calibrated in accordance with the size of the individual item stored in the dispenser so that each time one item is added to the trough 4 the number appearing at the window 20 is one digit higher. The lowest digit is 0 and the highest digit is the maximum quantity of items which can be stored in that particular dispenser. As items are removed from the trough 4, one by one, the spring 14 pushes the platform 2 forward which in turn forces the remaining items in the trough 4 toward the front of the dispenser 6. The sheet 16 is pushed forward at point A by the forward moving platform 2 and self coils around spindle 22. The self-recoiling properties of sheet 16 causes the sheet to coil around spindle 22 picking up any slack resulting from the forward motion of the platform 2. This avoids bunching up in the space between window 10 and pressure plate 21 or bulging through window 20, so that sheet 16 travels smoothly within the space 19 defined between window 20 and pressure plate 21. Space 19 is wide enough to allow smooth travel of the sheet 16. Pressure plate 21 maintains sheet 16 in a vertical position with respect to window 20 in order to make the number appearing at window 20 clearly visible. Deflector 18 acts to separate the coiled portion of sheet 16 around spindle 22, from the unwound portion of sheet 16. As sheet 16 coils, the number appearing at the window 20 decreases. When one item is removed from the trough 4 the number appearing at the window 20 decreases by one, thereby indicating the quantity of items left in the trough 4 and signaling to persons responsible for restocking, that the dispenser needs attention.

The dispensers are designed to be attached to each other, side by side, as shown in FIG. 5 and thereby assembled into shelves. These shelves can be in turn stacked vertically for maximum utilization of space.

By viewing the number appearing at the window 20, the inventory manager can tell how many items remain in each dispenser, even when, as is the case when groups of dispensers are attached horizontally and stacked vertically in close quarter storage, the items toward the rear of each dispenser are not visible from the front of the dispenser 6. In addition, the force of the spring 14 against the platform 2, assures that the items are always available at the front of the dispenser 6, with no gaps between items. The sides of the dispenser 28 serve to maintain orderly rows of items and segregation between different items stored in dispensers placed next to each other.

Figure 6:
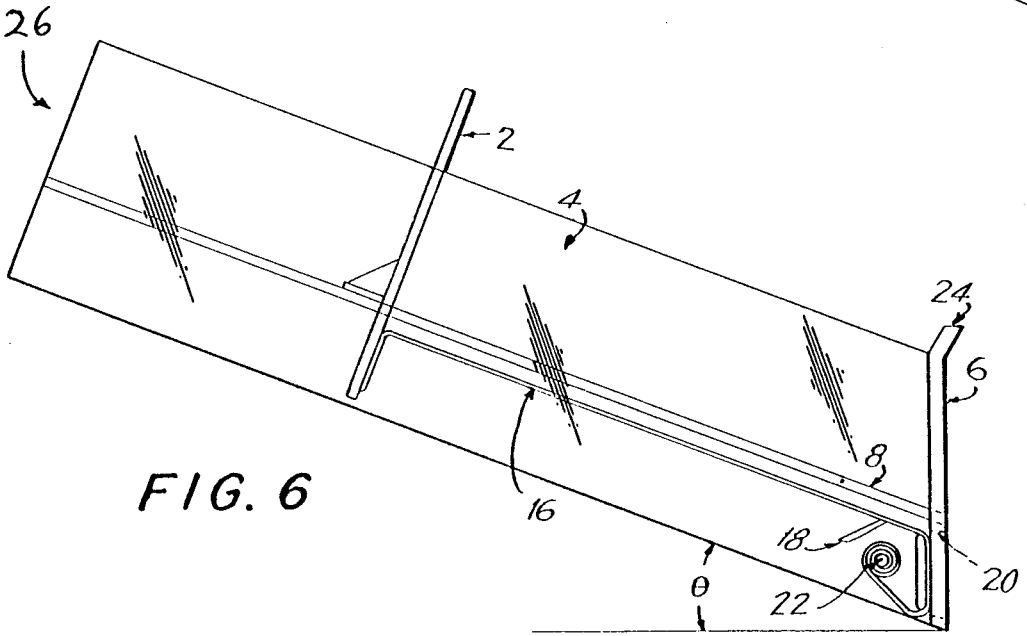
FIG. 6 is a lateral view of a second embodiment of the invention shown as being transparent so that the internal components can be viewed.

FIG. 6 illustrates a second embodiment of the invention which uses the force of gravity as the means for biasing the platform 2. Dispenser 26 is designed to be mounted at angle $\phi$ (defined between the bottom of the dispenser 26 and level ground) which is steep enough to cause the items stored in trough 4 to slide forward, followed by the platform 2, each time the item closest to the front of the dispenser 6, is removed. The sheet 16 is urged forward by platform 2 and operates to numerically indicate the number of items contained in trough 4, as described herein for the preferred embodiment.

The foregoing disclosure and description of the invention is illustrative and explanatory thereof and various changes in the size, shape and materials as well as in the details of the illustrated construction will still remain within the scope of the claims without departing from the spirit of the invention.

What is claimed is:

1. A dispenser for the storage, display, metering and dispensing of items, comprising:

(a) a trough, for containment of said items;

(b) a shelf forming the bottom of said trough upon which said items are aligned in a row, said shelf having longitudinal slot means disposed substantially along the length of said trough;

(c) an upright platform substantially perpendicular to said shelf, said platform movably disposed within said slot means of said shelf, said platform disposed adjacent to said items;

(d) means for biasing said platform to urge said platform in a direction toward the front end of said trough thereby urging said items in a direction toward said front end;

(e) means for digitally indicating the number of said items stored in said trough, comprising:

(i) a spindle mounted laterally across the width of the trough, said spindle disposed proximate the front end of said trough and under said platform;

(ii) a guide member positioned under said shelf and proximate said spindle;

(iii) an opening in said front end of said trough;

(iv) a pressure plate positioned adjacent to said opening, forming a space between said opening and said pressure plate;

(v) a resiliently self recoiling sheet with numerals depicted thereon, said sheet having a first and second end, said sheet being disposed under said shelf, said first end being attached to said platform, the remainder of said sheet being disposed under said shelf and between said guide member and said shelf and disposed within said space between said pressure plate and said opening, said pressure plate keeping said sheet in a substantiallyvertical position behind said opening, and said second end of said sheet being coiled around said spindle, the movement of said platform controlling the coiling and uncoiling of said sheet around said spindle as items are removed from, or added to the trough; and (f) numerals spaced along said sheet in calibration with the size of the items stored in the trough, the numeral visible through said opening corresponding to the number of items remaining in the trough.

* * * * *